US012377362B2

(12) United States Patent
Qu et al.

(10) Patent No.: US 12,377,362 B2
(45) Date of Patent: Aug. 5, 2025

(54) MAGNETIC CONSTRUCTION TILE SET

(71) Applicant: Retrospective Goods, LLC, New York, NY (US)

(72) Inventors: Shihan Qu, Denver, CO (US); Craig Zucker, New York, NY (US)

(73) Assignee: Retrospective Goods, LLC, New York, NY (US)

( * ) Notice: Subject to any disclaimer, the term of this patent is extended or adjusted under 35 U.S.C. 154(b) by 0 days.

(21) Appl. No.: 17/155,786

(22) Filed: Jan. 22, 2021

(65) Prior Publication Data

US 2022/0233969 A1 Jul. 28, 2022

(51) Int. Cl.

| | |
|---|---|
| ***A63H 33/26*** | (2006.01) |
| ***A63H 33/04*** | (2006.01) |
| *E04F 13/08* | (2006.01) |

(52) U.S. Cl.

CPC ..... *A63H 33/046* (2013.01); *E04F 13/0883* (2013.01)

(58) Field of Classification Search

CPC ..... A63H 33/046

See application file for complete search history.

(56) References Cited

U.S. PATENT DOCUMENTS 1,229,953 A * 6/1917 Heatlie ..... A63H 3/16 446/100
3,590,499 A * 7/1971 Rinehuls ..... G09B 11/00 434/92
4,334,871 A * 6/1982 Roane ..... A63H 33/046 434/211
4,792,319 A * 12/1988 Svagerko ..... A63H 33/08 446/104
7,152,381 B2 * 12/2006 Hasley ..... E04B 1/34 52/311.1

(Continued)

FOREIGN PATENT DOCUMENTS

CN 204864981 * 12/2015 ..... A63H 33/04
CN 207614351 * 7/2018 ..... A63H 33/04

(Continued)

OTHER PUBLICATIONS

Yoon, WO-2006132458 machine translation, uploaded Mar. 9, 2022, Espacenet, 7 pages.*

(Continued)

*Primary Examiner* — Eugene L Kim
*Assistant Examiner* — Matthew B Stanczak
(74) *Attorney, Agent, or Firm* — Calfee, Halter & Griswold LLP

(57) ABSTRACT

A manipulative construction set comprising a plurality of construction tiles. Each of the tiles can comprise a side forming a tile perimeter, wherein the side includes an inward extending pocket formed therein. Each of the tiles can further comprise a magnet rotatably retained within the pocket, wherein a portion of the magnet retained in the pocket is exposed. The exposed portion of the magnet can rotate between a first polarity and a second polarity such that a magnet of a first tile in the plurality of tiles and a magnet of a second tile in the plurality of tiles are capable of attracting the side of the first tile to the side of the second tile by rotating to generate attracting polarities between the magnet of the first tile and the magnet of the second tile.

15 Claims, 8 Drawing Sheets

(56) References Cited

U.S. PATENT DOCUMENTS 7,154,363 B2 * 12/2006 Hunts ..... H01F 7/0242 446/92
8,061,713 B2 * 11/2011 Cook ..... A63F 9/1204 273/156
8,491,312 B2 * 7/2013 Rudisill ..... H01R 11/30 439/39
9,314,707 B2 4/2016 Ornstein et al.
9,636,600 B2 5/2017 Rudisill et al.
9,653,844 B1 * 5/2017 Szeto ..... H01R 13/6205
9,774,136 B2 * 9/2017 Szeto ..... H01R 35/04
9,821,244 B1 * 11/2017 Whang ..... A63H 33/046
10,063,009 B2 * 8/2018 Szeto ..... H01R 13/6581
10,258,896 B2 4/2019 Ornstein et al.
10,857,475 B2 12/2020 Moskowitz
11,331,590 B2 * 5/2022 Grove ..... A63H 33/046
11,376,516 B2 * 7/2022 Kogure ..... A63H 33/26
11,833,443 B2 * 12/2023 Yamaai ..... A63H 29/22
2005/0248090 A1 * 11/2005 Anders ..... A63H 33/046 273/156
2006/0137270 A1 * 6/2006 Daftari ..... A63F 9/34 52/250
2006/0155388 A1 * 7/2006 Pietrzyk ..... A63H 33/046 700/2
2006/0240737 A1 * 10/2006 Yoon ..... A63H 33/046 446/92
2008/0202053 A1 8/2008 Guy et al.
2012/0164913 A1 * 6/2012 Pomeroy ..... A63H 33/046 446/137
2013/0109267 A1 * 5/2013 Schweikardt ..... A63H 33/046 446/85
2013/0225035 A1 * 8/2013 Miller ..... A63H 33/26 446/133
2013/0267145 A1 * 10/2013 Rosen ..... A63H 33/046 446/92
2014/0227934 A1 * 8/2014 Rudisill ..... A63H 33/046 446/92
2014/0227935 A1 * 8/2014 Yoon ..... A63H 33/046 446/92
2014/0274417 A1 * 9/2014 Brandwijk ..... A63F 13/00 463/43
2014/0302741 A1 * 10/2014 Whittaker ..... A63H 33/046 446/92
2015/0283474 A1 * 10/2015 Howard ..... G09B 23/04 446/85
2016/0074766 A1 * 3/2016 Choi ..... A63H 33/046 446/92
2016/0184727 A1 * 6/2016 Ornstein ..... A63H 33/046 446/92
2017/0149171 A1 * 5/2017 Szeto ..... H04M 1/0274
2017/0182429 A1 * 6/2017 Choi ..... A63H 33/046
2017/0197154 A1 * 7/2017 Bagley ..... A63H 33/046
2018/0056206 A1 * 3/2018 Micko ..... A63H 33/046
2020/0147508 A1 * 5/2020 Romanoff ..... A63H 33/086
2020/0184852 A1 * 6/2020 Hartloff ..... G09B 27/08
2021/0205727 A1 * 7/2021 Howard ..... A63H 27/12
2021/0213369 A1 * 7/2021 Yamaai ..... A63H 29/22
2021/0220723 A1 * 7/2021 Costello ..... A63F 3/00

FOREIGN PATENT DOCUMENTS

KR 100858698 B1 * 9/2008 ..... A63H 33/10
WO WO-2006132458 A1 * 12/2006 ..... A63H 33/046

OTHER PUBLICATIONS

Gong, CN-207614351 machine translation, uploaded Mar. 9, 2022, Espacenet, 9 pages.*
Lin, CN-204864981 machine translation, uploaded Mar. 9, 2022, Espacenet, 2 pages.*
Han, Machine Translation of KR10-0858698-B1, uploaded Oct. 17, 2022, Espacenet, 5 pages.*
"International Search Report and Written Opinion for PCT Patent Application No. PCT/US2022/018357", Mailed Date: Apr. 26, 2022, 12 pages.

* cited by examiner

MAGNETIC CONSTRUCTION TILE SET

BACKGROUND

Manipulative construction sets which can be assembled into three-dimensional geometric structures have been popular for many years. Mechanical interlocking structures have been employed to connect individual construction tiles together, but there are generally restrictions on assembly geometries or critical alignment requirements, excessive connection forces and angles, or cost issues driven by dimensional fabrication precision requirements. In response to these issues, magnets have been used to provide an easier assembly of plastic construction tiles. Conventionally, these magnets are embedded at an edge of the plastic construction tile to facilitate connecting edges of the construction tiles and to prevent removal of the magnet from the construction tile. However, embedding the entire magnet in the construction tile results in weaker bonds between the construction tiles because of the plastic barrier between the connected magnets. Moreover, because the magnet is embedded in the plastic construction tile, the polarity of the magnet is fixed resulting in limited orientations for connection of the construction tiles.

SUMMARY

The following is a brief summary of subject matter that is described in greater detail herein. This summary is not intended to be limiting as to the scope of the claims.

Disclosed herein are various technologies pertaining to a manipulative construction set configured for assembly into a three-dimensional geometric structure. According to an example, the manipulative construction set can comprise a plurality of tiles. Each of the tiles can comprise a side forming a tile perimeter, wherein the side comprises an inward extending pocket formed therein. Each of the tiles can further comprise a magnet rotatably retained within the pocket, wherein a portion of the magnet retained in the pocket is exposed. The exposed portion of the magnet can rotate about between a first polarity and a second polarity such that a magnet of a first tile in the plurality of tiles and a magnet of a second tile in the plurality of tiles are capable of attracting the side of the first tile to the side of the second tile by rotating to result in attracting polarities between the magnet of the first tile and the magnet of the second tile.

Because the magnets can rotate to form the attracting polarities between construction tiles, the construction tiles are not limited to particular connection orientations and can maintain their connection at different orientations. Moreover, because a portion of the magnet is exposed, the magnetic bond between construction tiles is maintained while stress is applied to the connected construction tiles. Further, due to the exposed rotating magnets in the construction tiles, a set of construction tiles can be configured to self-organize into a three-dimensional geometric structure when the set of construction tiles is placed in a container and shaking forces are applied to the container.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
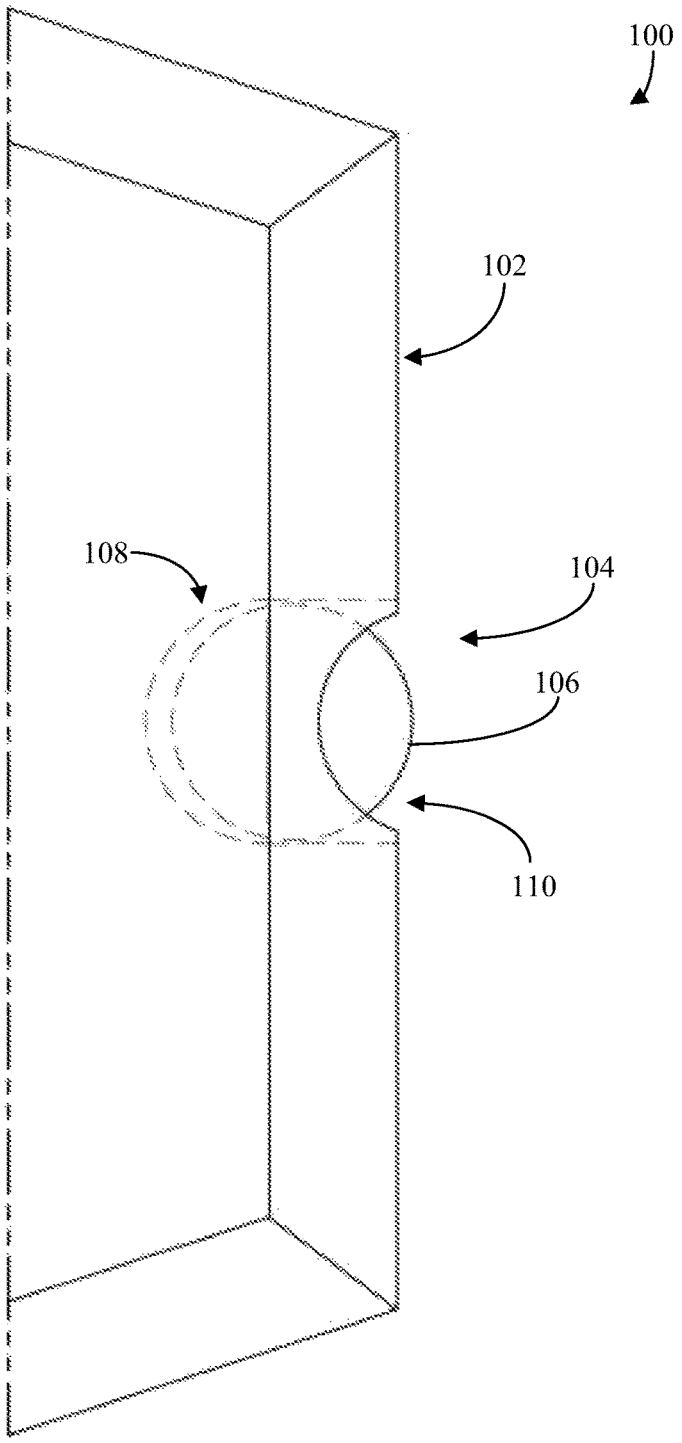
FIG. 1 illustrates an exemplary portion of a construction tile.

Various technologies pertaining to manipulative construction sets are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Disclosed is a magnetic manipulative construction set that comprises a plurality of construction tiles that are removably attachable to one another. Each construction tile includes a side with an exposed, rotatable magnet held therein. The magnets can rotate their polarities (as necessary) such that the magnets attract one another connecting the construction tiles together.

Turning to FIG. 1, illustrated is a portion of one embodiment of a magnetic construction tile 100. As illustrated in FIG. 1, the construction tile 100 comprises a side 102 that forms a perimeter of the constructions tile 100. The side 102 includes a magnet retaining structure 104 configured to retain a magnet 106 within the construction tile 100. More particularly, the magnet retaining structure 104 may be configured to retain the magnet 106 within a body of the construction tile 100 while a portion of the magnet 106 is exposed to an external environment. Because of the magnet 106, the constructions tile 100 will magnetically attract a magnet of another construction tile when the construction tile 100 and the other construction tile are brought into close proximity (e.g., when the magnet 106 and the magnet of the other construction tile are brought into close proximity).

Any suitable type of magnet 106 may be included in the construction tile 100. The magnet 106 can take any suitable shape and/or size with any suitable magnet strength; thus, the magnet 106 as well as a similar magnet of another construction tile can allow the constructions tile 100 and the other construction tile to attach and detach from each other as desired. In the illustrated embodiment, the magnet 106 comprises a spherical magnet. In another embodiment, the magnet 106 may comprise a cylindrical magnet, a bar magnet, and/or the like.

The side 102 of the construction tile 100 may include any suitable number of magnets. In the illustrated embodiment, the construction tile 100 includes a single magnet 106 along the side 102. In another embodiment, the construction tile 100 may include a plurality of magnets (and a corresponding plurality of magnet retaining structures) along the side 102, the plurality of magnets may be similar or may vary. For instance, where the plurality of magnets comprises two magnets, in one embodiment both magnets may be spherical magnets, while in another embodiment one magnet is a spherical magnet while the other magnet is a cylindrical magnet.

The strength of the magnetic attraction between adjacent construction tiles may depend on the strength of the magnet in each construction tile (e.g., the strength of the magnet 106 and the strength of the magnet in an adjacent construction tile). For instance, where one or both magnets has a high strength, it may be difficult to separate the construction tile 100 from the adjacent construction tile, while conversely weaker strength magnets may result in the set being unable to maintain connection between the construction tiles. Accordingly, the magnet 106 may have any suitable strength for maintaining connection between construction tiles to assemble a three-dimensional geometric structure, as will be described in detail below.

Moreover, the strength of the magnet may be a function of the size and/or weight of the construction tile it is located in. This relationship can be exemplified by a ratio of magnet power to construction tile weight. For instance, a magnet power to tile weight ratio may be at least 40× (e.g., the magnet power may be at least 40 times the tile weight). According to an example, the magnet power to tile weight ratio may be in a range from 40× to 100×; however, other ratios of the magnet power to the tile weight are contemplated.

The magnet 106 may comprise any suitable material for attaching construction tiles together. For instance, the magnet 106 may be a rare-earth magnet made from rare-earth elements. By way of another example, the magnet 106 may comprise a neodymium magnet and/or a samarium-cobalt magnet.

The magnet 106 may further comprise portions that have different polarities (e.g., a north pole and a south pole). For instance, in the case of the magnet 106 being or including a spherical magnet, the spherical magnet may have a first hemisphere that is a north pole and a second hemisphere that is a south pole. In another example, in the case of the magnet 106 being or including a cylindrical magnet, a first portion of curved surface extending along the length of the cylindrical magnet can be a north pole and a second portion of curved surface extending along the length of the cylindrical magnet can be a south pole.

The magnet retaining structure 104 is configured to permit the magnet 106 to rotate between these polarities, as will be described below. For example, because the magnet 106 can rotate between polarities, when a magnetic material (e.g., a magnet in another construction tile) approaches the magnet 106, the magnet 106 may rotate (as necessary) to result in an attractive force between the magnet 106 and the magnetic material.

In order to connect sides of adjacent construction tiles via the attractive force between their magnets, the magnet 106 is retained at a side of the construction tile 100 via the magnet retaining structure 104. The magnet retaining structure 104 is configured to rotatably retain the magnet 106 at the side 102 of the construction tile 100 while leaving a portion of the magnet 106 exposed to the external environment. This exposed portion of the magnet 106 helps to establish a stronger connection between adjacent construction tiles.

The magnet retaining structure 104 can take any suitable shape and/or include any suitable components to rotatably retain the magnet 106 therein and may depend on the magnet 106 employed. For instance, in FIG. 1, where the magnet 106 is spherical, the magnet retaining structure 104 may comprise an inward extending pocket 108 and an opening 110 in the side 102 to permit the portion of the magnet 106 exposure to the external environment. In another example, where the magnet 106 comprises a cylindrical magnet, the magnet retaining structure 104 may include a pocket within the construction tile to retain the cylindrical magnet, an opening to expose a portion of the cylindrical magnet, and a pin that extends through the cylindrical magnet along an axis of the cylindrical magnet. The cylindrical magnet may rotate about this pin while remaining in the pocket.

In the illustrated embodiment, the pocket 108 has a U-shaped cross-section that is embedded in the construction tile 102. The pocket 108 may take any suitable shape and size for retaining the magnet 106 therein. For instance, the U-shaped cross-section may be sized to permit movement (e.g., horizontally, vertically, rotationally, etc.) of the magnet 106 within the pocket 108 while retaining a portion of magnet 106 outside the pocket 108. In the illustrated embodiment, the pocket 108 is sized to permit lateral movement of the magnet 106 within the pocket 108, i.e. the magnet 106 can move further in and out of the pocket 108 relative to the side 102.

The opening 110 in the side 102 can take any suitable shape for retaining the magnet in the pocket 108 while exposing a portion of the magnet 106. In the illustrated embodiment, the opening 110 has a cross-section that is smaller than the cross-section of the pocket 108 such that a portion of the magnet 106 can stick out of the opening (as seen in FIG. 1). As mentioned above, exposing a portion of the magnet 106 may permit for a stronger connection between the construction tiles in the set.

The pocket 108 and the opening 110 may be sized to permit the magnet 106 to rotate between polarities. As discussed above, the magnet 106 may rotate (as necessary) to generate attracting forces between the magnet 106 in the construction tile 100 and another magnet in an adjacent construction tile. More particularly, the pocket 108 and the opening 110 may be configured to permit the exposed portion of the magnet 106 to change polarities (as necessary).

The opening 110 may be further configured to prevent the magnet 106 from extending beyond the side 102 of the construction tile 100. When adjacent construction tiles are connected by the attractive forces between their magnets, their respective sides abut one another. The opening 110 may be configured to generally retain the magnet 106 within the construction tile 100 while allowing the portion of the magnet 106 to be exposed without the magnet 106 extending beyond the side 102. The abutment between adjacent construction tiles can be seen in at least FIG. 2.

Figure 2:
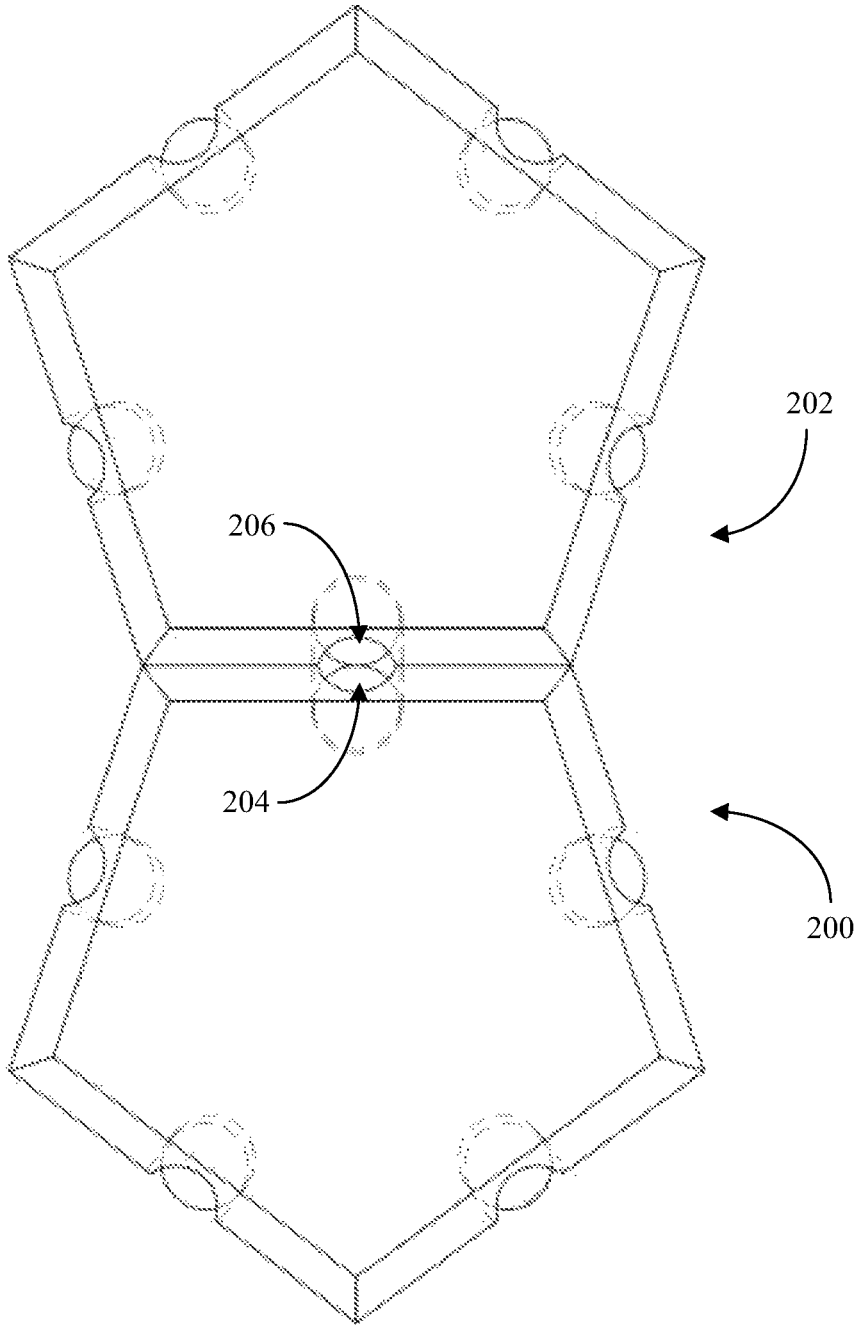
FIG. 2 illustrates an exemplary set of construction tiles.

FIG. 2 illustrates an exemplary embodiment where two adjacent construction tiles 200 and 202 are attached together because of attractive forces between a magnet 204 and 206 in each of the construction tiles 200 and 202, respectively (e.g., each of the construction tiles 200 can be substantially similar to the construction tile 100). As shown in FIG. 2, when the magnets 204 and 206 attract one another, sides of the construction tiles 200 and 202 may abut one another. For instance, a manipulative construction set can include the construction tiles 200 and 202 (as well as any number of additional construction tiles).

The side acts as a perimeter of the construction tile and defines a cross-sectional shape of the construction tile. The construction tile can take any suitable cross-sectional shape while maintaining the features described above. In one embodiment, illustrated in at least FIG. 2, the construction tile 200 has a cross-section that is pentagonal comprised of five connected portions. In another embodiment, the construction tile may have a cross-section that is triangular, circular, rectangular, ovular, polygonal, and/or other two dimensional geometric shapes. Each side may have a magnet and a corresponding magnet retaining structure for retaining said magnet in the side. In another embodiment, one or more of the sides may not have a magnet. In a further embodiment, one or more of the sides may include a plurality of magnets with a corresponding plurality of magnet retaining structures.

As briefly noted above, because of the attracting forces between the magnets in the construction tiles, a set of construction tiles can be attached to one another to form a three-dimensional connected structure. Different connected structures can be formed by assembling different sets of construction tiles (e.g., a first set of construction tiles can be assembled to form a first connected structure while a second set of construction tiles can be assembled to form a second connected structure). Moreover, different connected structures may be formed by a set of construction tiles by assembling the construction tiles in varying configurations.

The construction tiles in a particular set may be similar and/or may vary. In one embodiment, the construction tiles in the set have similar shape, size, magnet strength, magnet type, and/or the like. For instance, in the illustrated embodiments, the construction tiles in the set comprise a similar pentagonal shape and size. In another embodiment, the construction tiles in the set vary in shape, size, magnet strength, magnet type, and/or the like.

In order to facilitate assembling a connected structure, the construction tiles may be configured to align at a particular angle when attached together. For instance, a side of a first construction tile may be sloped to cause a second construction tile attached at that side to extend from the first construction tile at an angle. This angled attachment between connected construction tiles is illustrated in FIG. 3.

Figure 3:
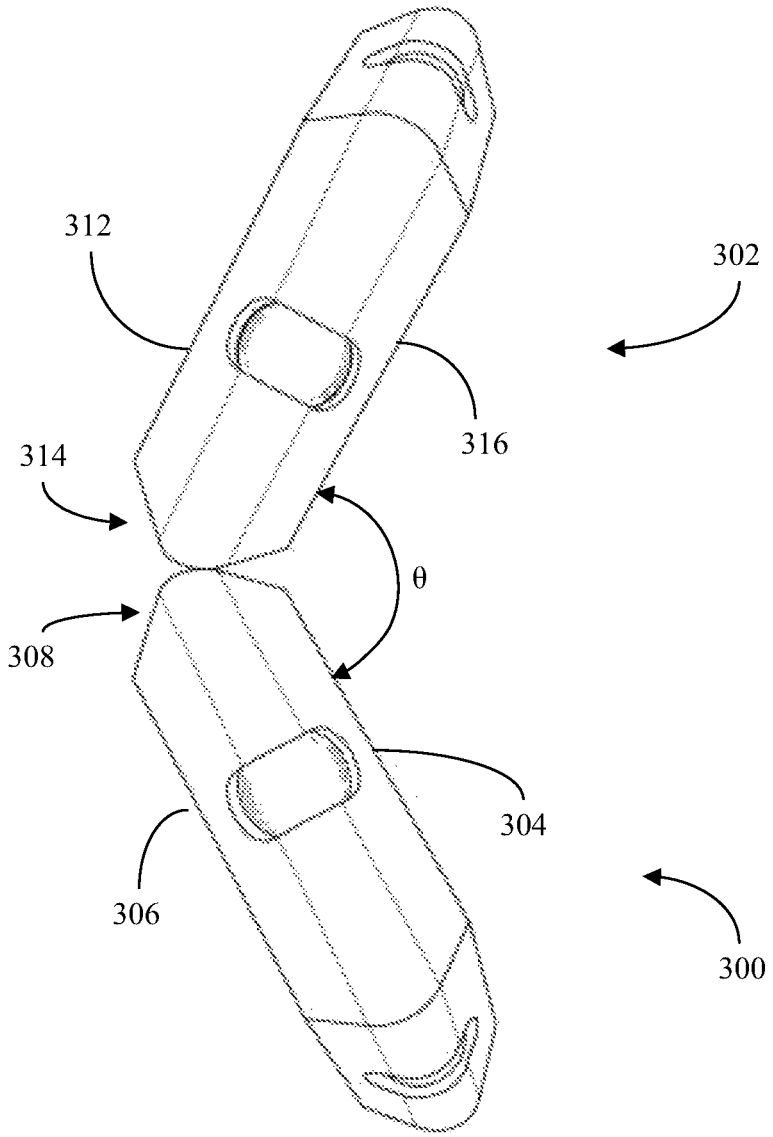
FIG. 3 illustrates another exemplary set of construction tiles.

FIG. 3 illustrates an embodiment where a first construction tile 300 and a second construction tile 302 are connected at a dihedral angle θ (e.g., the first construction tile 300 may be substantially similar to the construction tile 200 and the second construction tile 302 may be substantially similar to the construction tile 202, a manipulative construction set can include at least the construction tiles 300-302). The first construction tile 300 and the second construction tile 302 can be attached at any suitable dihedral angle θ. In one embodiment, the dihedral angle θ may depend on the connected structure being formed. For instance, the dihedral angle θ may form an interior angle of a dodecahedron.

In the illustrated embodiment, the first construction tile 300 comprises opposing planar surfaces 304 and 306 and a side 308 extending therebetween. As illustrated, the side 308 slopes outwardly from the first planar surface 304 and the second planar surface 306 toward a rounded end. Similar to the first construction tile 300, the second construction tile 302 may comprise opposing planar surfaces 310 and 312 with a sloping side 314 therebetween. The sloping side 314 of the second construction tile 302 may be similar to the sloping side 308 of the first construction tile 300 or they may vary.

Description will now be made with reference to the side 308 in the first construction tile 300, however the proceeding description may also apply to the side 314 of the second construction tile 302. The side 308 can slope at any suitable angle from the first planar surface 304 and/or the second planar surface 306. In the illustrated embodiment, the side 308 has a similar angle from the first planar surface 304 as from the second planar surface 306. The use of similar angles for the slope of the side 308 from the first planar surface 304 and from the second planar surface 306 results in the second construction tile 302 forming the same angle θ with the second construction tile 302 regardless of orientation of the first construction tile 300. In another embodiment, the side 308 may have a first angle with respect to the first planar surface 304 and a different second angle with respect to the second planar surface 306. Moreover, the angle each portion of the side 308 makes with the planar surface (e.g., the first planar surface 304) can be similar and/or can vary. The side 308 may have any suitable angle with the planar surface (e.g., the first planar surface 304) for forming the dihedral angle θ between the first construction tile 300 and the second construction tile 302. Accordingly, the angle with the planar surface(s) may be a function of the interior angle of the three-dimensional geometric structure formed with the manipulative construction set.

As described above, the construction tiles may include a plurality of sides which each have a corresponding magnet retained therein. Because of the plurality of magnets in each construction tile, multiple construction tiles may be interconnected while generating the connected structure. For instance, a first magnet in a first construction tile can be attached to a first magnet in a second construction tile, while a second magnet in the first construction tile is attached to a first magnet in a third construction tile. The second construction tile and the third construction tile may also include multiple sides with multiple magnets permitting the second construction tile and the third construction tile to be attached together via another magnet in each of those tiles.

Figure 4:
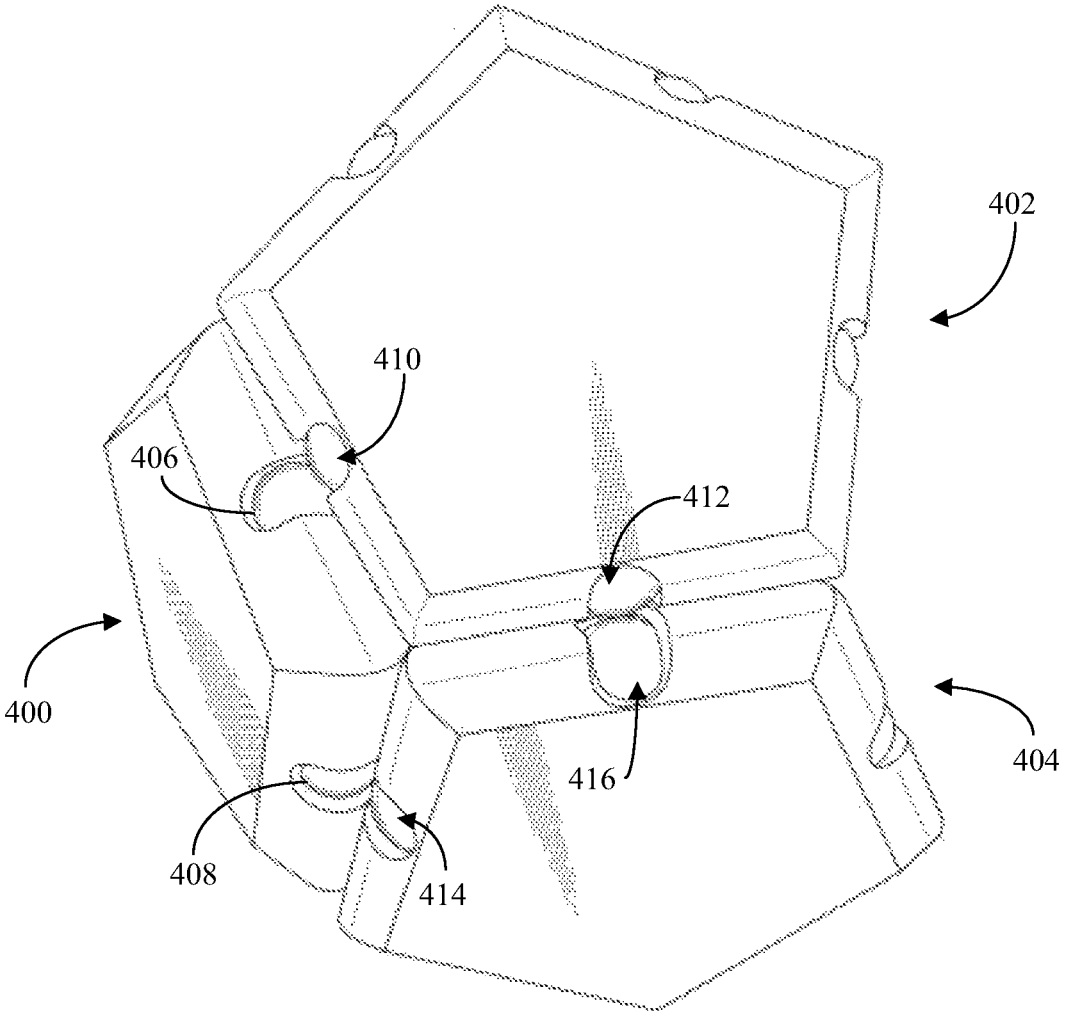
FIG. 4 illustrates a further exemplary set of construction tiles.
Figure 5:
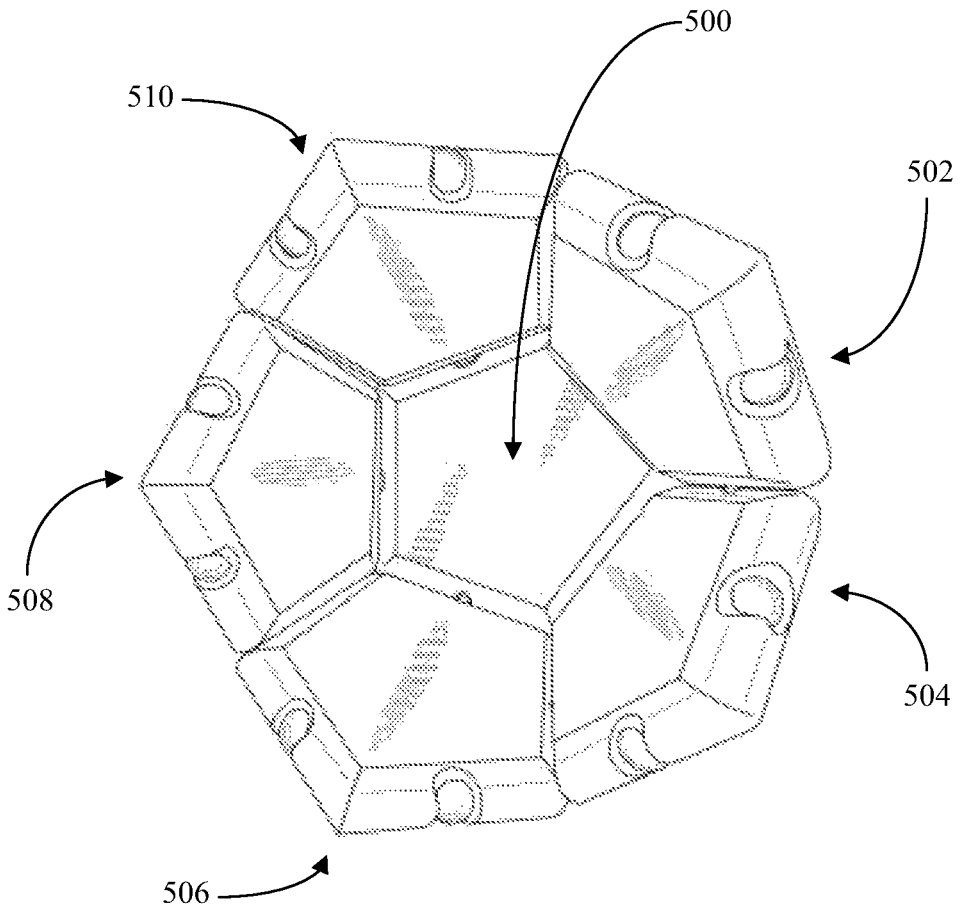
FIG. 5 illustrates a yet further exemplary set of construction tiles.
Figure 6:
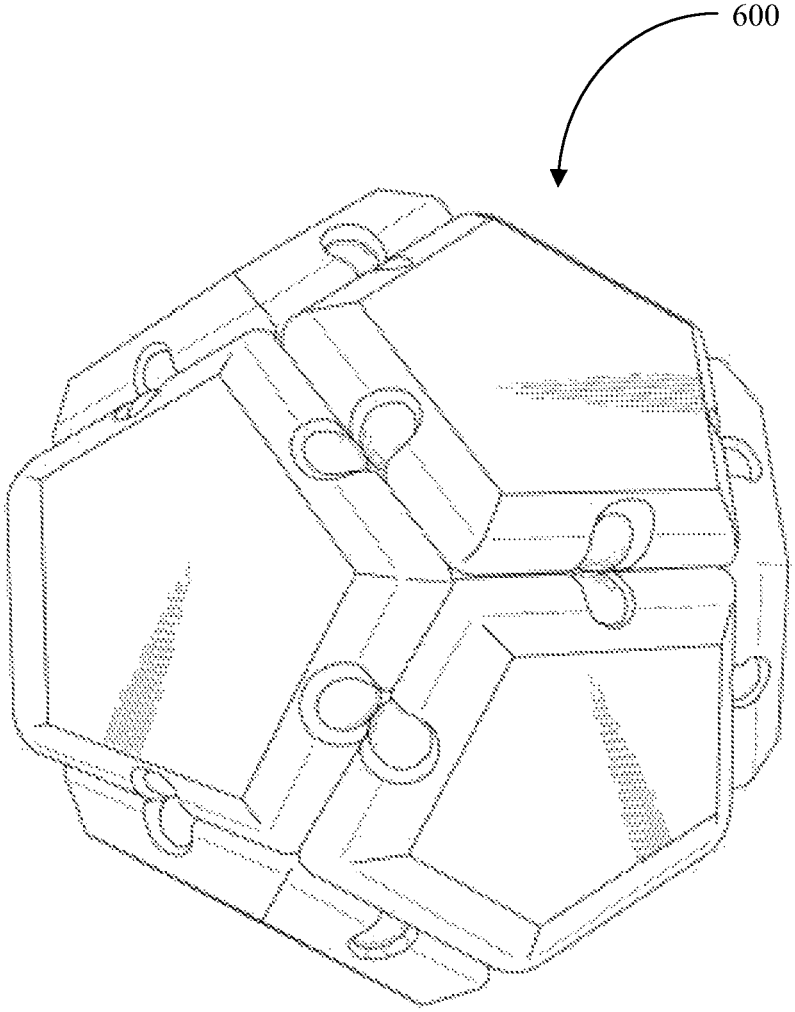
FIG. 6 illustrates an exemplary set of construction tiles assembled in a three-dimensional geometric structure.

This interconnection of multiple construction tiles can be seen in at least FIGS. 4-6. For instance, FIG. 4 illustrates an embodiment where a first construction tile 400, a second construction tile 402, and a third construction tile 404 are all connected together (e.g., the construction tiles 400-404 can be substantially similar to the construction tiles described above, a manipulative construction set can include at least the construction tiles 400-404). As illustrated, the first construction tile 400 includes a first magnet 406 and a second magnet 408, the second construction tile 402 includes a first magnet 410 and a second magnet 412, and the third construction tile 404 includes a first magnet 414 and a second magnet 416. In the embodiment illustrated in FIG. 4, the first construction tile 400 and the second construction tile 402 are attached together via the first magnet 406 in the first construction tile 400 and the first magnet 410 in the second construction tile 402. The first construction tile 400 is further attached to the third construction tile 404 via the second magnet 408 in the first construction tile 400 and the first magnet 414 in the third construction tile 404. Because of the geometry of the three construction tiles 400, 402, and 404, the second construction tile 402 and the third construction tile 404 can attach to one another when they are attached to the first construction tile 400. As seen in FIG. 4, the second magnet 412 of the second construction tile 402 aligns with and attaches to the second magnet 416 of the third construction tile 404.

Turning now to FIG. 5, illustrated is an embodiment where a set includes six similarly shaped and sized tiles have been attached together. FIG. 5 illustrates a first construction tile 500 with five construction tiles 502, 504, 506, 508, and 510 attached thereto. Each illustrated construction tile is pentagonal with five sides with at least one magnet in each of the sides (e.g., the construction tiles 500-510 can be substantially similar to the constructions tiles described above, a manipulative construction set can include at least the construction tiles 500-510). One of the five construction tiles 502, 504, 506, 508, and 510 is attached to each of the five sides of the first construction tile 500. Similar to FIG. 4, because of the geometry of the construction tiles 500, 502, 504, 506, 508, and 510 and the presence of magnets on each side of the construction tiles 500, 502, 504, 506, 508, and 510, the five construction tiles 502, 504, 506, 508, and 510 may be further attached to one another when they are attached to the first construction tile 500.

Turning now to FIG. 6, illustrated is an embodiment of a connected structure 600 formed by a set of construction tiles (e.g., formed by construction tiles of a manipulative construction set). In the illustrated embodiment, the connected structure 600 comprises a dodecahedron formed by twelve interconnected pentagonal construction tiles. Each construction tile includes five sides which each have at least one magnet therein (e.g., each of the construction tiles can be substantially similar to the construction tiles described above). In order to form the dodecahedron, each construction tile is connected to five other construction tiles (i.e., each side of the construction tile is connected to a construction tile). In the illustrated connected structure, the angle θ between a first construction tile and an attached second construction tile can be 116.56°.

The connected structure, whether the embodiment illustrated in FIG. 6 or any other desired embodiment, can be formed via any suitable manner. For instance, a user may manually connect the construction tiles in a set to form a connected structure.

In another embodiment, the construction tiles may attract to one another and self-organize into the connected structure when forces are applied to a container retaining the construction tiles. More particularly, because of the features of the construction tiles described above, when sufficient force is applied to the container holding the construction tiles, the construction tiles attract one another because of the rotating magnets and because of the sloped sides the construction tiles align at a particular angle when connecting to form the connected structure.

The container may take any suitable shape that causes the construction tiles to self-organize into the connected structure when the forces are applied to the container. For instance, the container may comprise a cylindrical container, a spherical container, a non-circular container (e.g., rectangular, polygonal, triangular, etc.) and/or the like. The container may be further configured to selectively hold objects within the container such that a user can add and remove objects from the container as desired. For instance, the container may comprise a lid movable between an open position permitting a user to insert construction tiles into an interior of the container and/or to remove a connected structure and a closed position to retain the connection tiles within the container while the forces are applied to the container.

The container may be subjected to any suitable forces that cause the construction tiles held therein to self-organize into the connected structure. For instance, the container may be shaken by subjecting the container to a plurality of linear and rotational forces.

Figure 7:
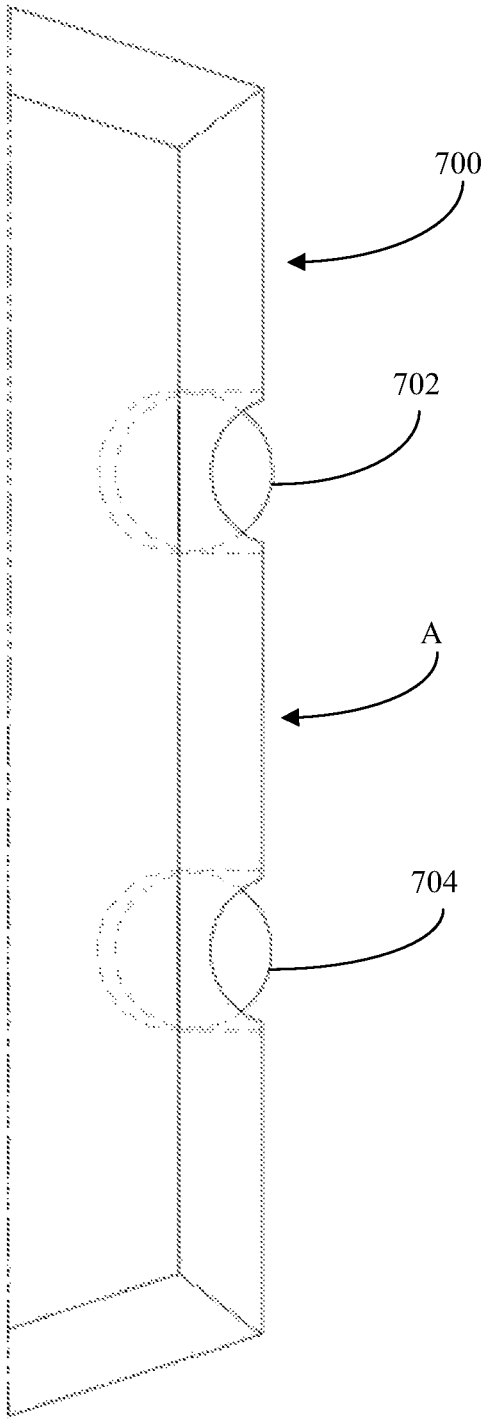
FIG. 7 illustrates another exemplary portion of a construction tile.

Turning now to FIG. 7, as briefly mentioned above, the side of a construction tile may include one or more magnets. The magnet may be located at any suitable location along the side for connecting construction tiles to form the connected structure. In one embodiment, in order to facilitate self-organization of the construction tiles, the magnet may be symmetrically located in the side such that as the construction tiles attach to one another the sides of the construction tiles are aligned. For instance, the magnet can be located at a center of the side (as illustrated in FIG. 1). In another embodiment, the magnet may be located at a non-central location in the side.

In a yet further embodiment, as illustrated in FIG. 7, a side 700 of a construction tile can include two magnets 702 and 704. Each of the two magnets 702 and 704 may be located at any suitable location in the side 700 and may have any suitable spacing therebetween. For instance, in the illustrated embodiment, the two magnets 702 and 704 are equally spaced from a mid-point A of the side 700. Where each construction tile in a set includes multiple magnets per side (e.g., two magnets per side), in order to facilitate self-organization into a connected structure, the magnets can be evenly spaced from a mid-point of the side such that a side of a first construction tile can align with and attach to a side of a second construction tile. In the illustrated embodiment, the first magnet 702 and the second magnet 704 comprise similar magnet types (e.g. spherical magnets), however they may vary. Moreover, the magnets 702 and 704 may have similar strengths or the strengths of magnets 702 and 704 may vary.

Figure 8:
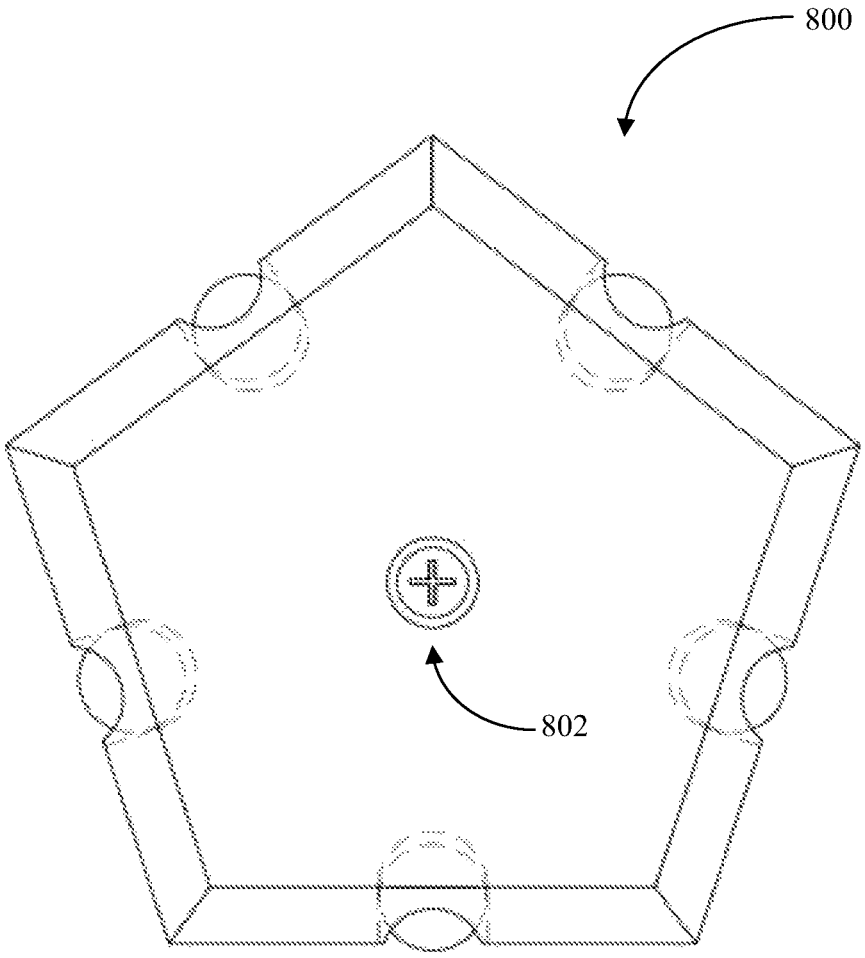
FIG. 8 illustrates an exemplary construction tile.

The construction tile can be formed via any suitable manufacturing technique. For example, a construction tile may be formed of a plurality of parts that are then assembled together to form the construction tile illustrated in the preceding embodiments. FIG. 8 illustrates an exemplary embodiment where a body of a construction tile 800 is formed of two separate halves that are joined by a screw 802. Each of the halves can be manufactured via any suitable method, such as injection molding, extrusion, and/or the like.

Each of the halves can include corresponding indentations to retain a magnet therein. As the halves are secured together via the screw 802, the indentations can align and retain the magnet within the construction tile 800. More particularly, the construction tile 800 can be assembled by placing a magnet (e.g., a spherical magnet) in an indentation of a first half of the body of the construction tile 800. A second half of the body is aligned with and secured to the first half via the screw 802. As the first half and the second half are secured together, the indentation in the first half and an indentation in the second half align to form a magnet retaining structure to retain the magnet in the assembled construction tile 800.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A manipulative construction set, the set comprising:

a plurality of pentagonal tiles, wherein each pentagonal tile comprises:

a first planar surface;

a second planar surface opposing the first planar surface;

five sides between the first planar surface and the second planar surface, wherein the five sides form a perimeter of the pentagonal tile, and wherein each of the five sides comprises:

an end;

a first slope between the first planar surface and the end, the first slope being at a first angle relative to the first planar surface;

a second slope between the second planar surface and the end, the second slope being at a second angle relative to the second planar surface; and an inward extending pocket having a U-shaped cross-section;

wherein an opening is formed through the end, the first slope, and the second slope of the side into the inward extending pocket; and five spherical magnets, wherein each of the five sides includes a corresponding one of the five spherical magnets, wherein each spherical magnet included in the corresponding side is rotatably retained within the pocket, wherein the U-shaped cross-section of the pocket is sized to permit movement of the spherical magnet within the pocket while retaining a portion of the spherical magnet outside the pocket such that the portion of the spherical magnet retained outside the pocket is exposed through the opening formed through the end, the first slope, and the second slope, wherein the spherical magnet rotates while the portion of the spherical magnet is retained outside the pocket such that the portion of the spherical magnet outside the pocket and exposed through the opening is changeable between a first polarity and a second polarity, and wherein the opening is sized to retain the spherical magnet within the pocket and the pocket is sized such that the portion of the spherical magnet extends through the opening formed through the end, the first slope, and the second slope; and wherein a spherical magnet of a first tile in the plurality of tiles and a spherical magnet of a second tile in the plurality of tiles are capable of attracting the side of the first tile to the side of the second tile by rotating to attracting polarities such that the perimeter of the first tile abuts the perimeter of the second tile, wherein the first angle of the first slope of the first tile and the first angle of the first slope of the second tile cause the first slope of the first tile and the first slope of the second tile to abut with the first planar surface of the first tile and the first planar surface of the second tile aligned such that the first tile and the second tile are attached at a dihedral angle where the first planar surface of the first tile and the first planar surface of the second tile form an interior angle of a dodecahedron when attractive forces between the spherical magnet exposed through the opening of the first tile and the spherical magnet exposed through the opening of the second tile connect the first tile and the second tile.

2. The manipulative construction set of claim 1, wherein the plurality of pentagonal tiles are configured to attract one another to self-organize into the dodecahedron when shaken with threshold forces for a threshold period of time in an enclosed container.

3. The manipulative construction set of claim 1, wherein the plurality of pentagonal tiles comprises twelve pentagonal tiles.

4. The manipulative construction set of claim 1, wherein a pentagonal tile of the plurality of pentagonal tiles has a magnet power to tile weight ratio of at least 40×.

5. The manipulative construction set of claim 1, wherein the plurality of pentagonal tiles are organizable into the dodecahedron, wherein the first angle of the first slope relative to the first planar surface is a function of interior angles in the dodecahedron.

6. The manipulative construction set of claim 5, wherein the second angle of the second slope relative to the second planar surface is the same as the first angle of the first slope relative to the first planar surface.

7. The manipulative construction set of claim 1, wherein each of the five sides of pentagonal tile further comprises a corresponding second spherical magnet, wherein each of the five sides further comprises an inward extending second pocket, wherein a second opening is formed through the end, the first slope, and the second slope of the side into the inwardly extending second pocket, wherein the pocket and the second pocket are spaced symmetrically about a center point of the side, wherein the second spherical magnet is rotatably retained within the second pocket.

8. The manipulative construction set of claim 1, wherein the spherical magnets comprise rare earth magnets.

9. A manipulative construction set comprising:

a plurality of pentagonal construction tiles each having opposing planar surfaces and five sides extending between the opposing planar surfaces, wherein each of the five sides comprises an end and slopes respectively between the opposing planar surfaces and the end, wherein the slopes are at angles relative to the respective opposing planar surfaces, wherein each pentagonal construction tile includes exposed spherical magnets, wherein each of the exposed spherical magnets is rotatably retained in a corresponding magnet retaining structure, wherein in each of the fives sides an opening is formed through the end and the slopes of the side into the magnet retaining structure, wherein the opening is sized to retain the spherical magnet within the magnet retaining structure and the magnet retaining structure is sized to retain a portion of the spherical magnet outside the magnet retaining structure such that the portion of the spherical magnet extends through the opening formed through the end and the slopes of the side, wherein the spherical magnet rotates while the portion of the spherical magnet is retained outside the magnet retaining structure such that the portion of the spherical magnet that is retained to extend through the opening is changeable between a first polarity and a second polarity, wherein the plurality of pentagonal construction tiles connect to form a dodecahedron when all of the plurality of pentagonal construction tiles are connected together, and wherein angles of slopes of the pentagonal construction tiles cause the slopes of the pentagonal construction tiles to abut with planar surfaces of the pentagonal construction tiles aligned such that the pentagonal construction tiles are attached at dihedral angles where the planar surfaces of the pentagonal construction tiles form interior angles of the dodecahedron when attractive forces between spherical magnets exposed through openings of the pentagonal construction tiles connect the pentagonal construction tiles.

10. The manipulative construction set of claim 9, wherein the plurality of pentagonal construction tiles comprises twelve pentagonal construction tiles.

11. The manipulative construction set of claim 10, wherein each side of the pentagonal construction tile includes a spherical magnet.

12. The manipulative construction set of claim 9, wherein a pentagonal construction tile from the plurality of pentagonal construction tiles further includes an exposed second spherical magnet rotatably retained at the side of the pentagonal construction tile.

13. The manipulative construction set of claim 9, wherein a pentagonal construction tile of the plurality of pentagonal construction tiles has a magnet power to pentagonal construction tile weight ratio of at least 40×.

14. The manipulative construction set of claim 9, wherein the spherical magnet comprises a rare earth magnet.

15. The manipulative construction set of claim 9, wherein the angles relative to the respective opposing planar surfaces are the same for each of the pentagonal construction tiles.

* * * * *